US010648178B2

(12) United States Patent
Stacye

(10) Patent No.: US 10,648,178 B2
(45) Date of Patent: May 12, 2020

(54) GUTTER COVER AND BRACKET SYSTEM AND METHOD OF INSTALLATION

(71) Applicant: Douglas M. Stacye, Greenwood, MO (US)

(72) Inventor: Douglas M. Stacye, Greenwood, MO (US)

( * ) Notice: Subject to any disclaimer, the term of this patent is extended or adjusted under 35 U.S.C. 154(b) by 0 days.

(21) Appl. No.: 16/426,509

(22) Filed: May 30, 2019

(65) Prior Publication Data

US 2019/0277034 A1 Sep. 12, 2019

Related U.S. Application Data

(63) Continuation-in-part of application No. 15/936,998, filed on Mar. 27, 2018, now abandoned.

(60) Provisional application No. 62/477,488, filed on Mar. 28, 2017.

(51) Int. Cl.
*E04D 13/076* (2006.01)
*E04D 13/072* (2006.01)

(52) U.S. Cl.
CPC ..... *E04D 13/076* (2013.01); *E04D 13/0725* (2013.01)

(58) Field of Classification Search
CPC ..... E04D 13/076; E04D 13/0725
See application file for complete search history.

(56) References Cited

U.S. PATENT DOCUMENTS 5,845,435 A 12/1998 Knudson
7,726,077 B2 6/2010 Downling et al.
8,997,403 B1 4/2015 Steinberg et al.
2004/0250478 A1 12/2004 McDonald et al.
2005/0108951 A1* 5/2005 McDonald ..... E04D 13/064 52/11
2005/0115158 A1 6/2005 Brown
2006/0037255 A1* 2/2006 Brochu ..... E04D 13/076 52/14
2006/0265968 A1 11/2006 Lowrie
2006/0277831 A1* 12/2006 Bachman ..... E04D 13/076 52/11
2007/0119104 A1 5/2007 Pijanowski
2007/0277446 A1* 12/2007 Dowling ..... E04D 13/076 52/11
2009/0139180 A1 6/2009 Kehs et al.
2010/0251626 A1 10/2010 Alonso
2011/0114800 A1 5/2011 Gramling
(Continued)

OTHER PUBLICATIONS

"The Gutter Cover. Features & Benefits.", www.theguttercovercompany.com/features-benefits/.

*Primary Examiner* — Brian D Mattei

(74) *Attorney, Agent, or Firm* — Law Office of Mark Brown, LLC; Christopher M. DeBacker

(57) ABSTRACT

A gutter cover system including a mounting bracket, gutter clip, and a cover piece. The mounting bracket attaches into the internal space within the gutter and is attached to a structural portion of the building to which the gutter is attached. The clip helps secure the bracket within the lip of the gutter. The bracket includes a structural tower for supporting the upper portion of the cover and a receiver platform for receiving a lower portion of the cover. The cover is non-uniform and includes several structural ridges to provide structural integrity.

8 Claims, 8 Drawing Sheets

(56) References Cited

U.S. PATENT DOCUMENTS

| | | | |
|---|---|---|---|
| 2012/0222366 | A1 | 9/2012 | Steinberg et al. |
| 2015/0284961 | A1 | 10/2015 | Iannelli |

* cited by examiner

GUTTER COVER AND BRACKET SYSTEM AND METHOD OF INSTALLATION

CROSS-REFERENCE TO RELATED APPLICATION

This application is a continuation-in-part and claims priority in U.S. patent application Ser. No. 15/936,998, filed Mar. 27, 2018, which claims priority in U.S. Provisional Patent Application No. 62/477,488 Filed Mar. 28, 2017, which is incorporated herein by reference.

BACKGROUND OF THE INVENTION

1. Field of the Invention

The present invention relates generally to a gutter cover system and method for use thereof, and more specifically to a gutter cover system with support and installation bracket.

2. Description of the Related Art

Gutter cover systems which shield gutters from above have become quite popular. They prevent debris from accumulating in the gutters and prevent squirrels, birds and other wildlife access to the gutter. This alleviates the need for the occasional physical act of cleaning the gutters.

While previous systems have employed a combination bracket and cover system for providing these advantages, most of those require roof attachments due to lack of support of the cover element.

Heretofore there has not been available a system or method for a gutter cover and bracket system with the advantages and features of the present invention.

BRIEF SUMMARY OF THE INVENTION

The present invention generally provides a gutter cover system including a mounting bracket, gutter clip, and a cover piece. The mounting bracket attaches into the internal space within the gutter and is attached to a structural portion of the building to which the gutter is attached. The clip helps secure the bracket within the lip of the gutter. The bracket includes a structural tower for supporting the upper portion of the cover and a receiver platform for receiving a lower portion of the cover. The cover is non-uniform and includes several structural ridges to provide structural integrity.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Gutter Cover System 2

Figure 1:
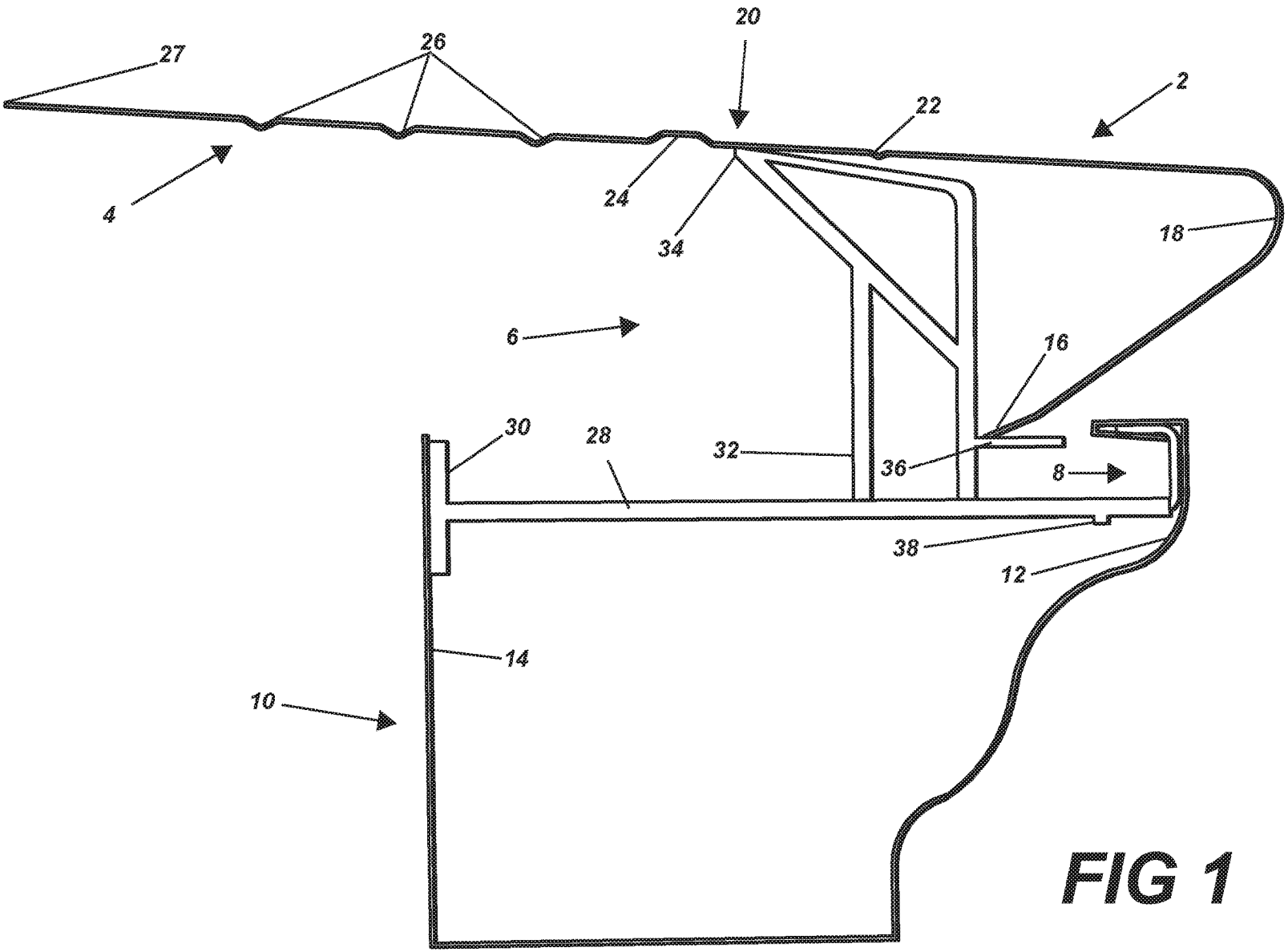
FIG. 1 is a side elevational view of a preferred embodiment of the present invention in a fully assembled position within a typical environment of a gutter.

As shown in the FIG. 1, the gutter cover system 2 includes three elements: a cover element 4; a mounting bracket element 6; and a gutter clip 8. The gutter cover system 2 is designed to be installed into a gutter 10 between its rear wall 14 and front lip 12.

Figure 2:
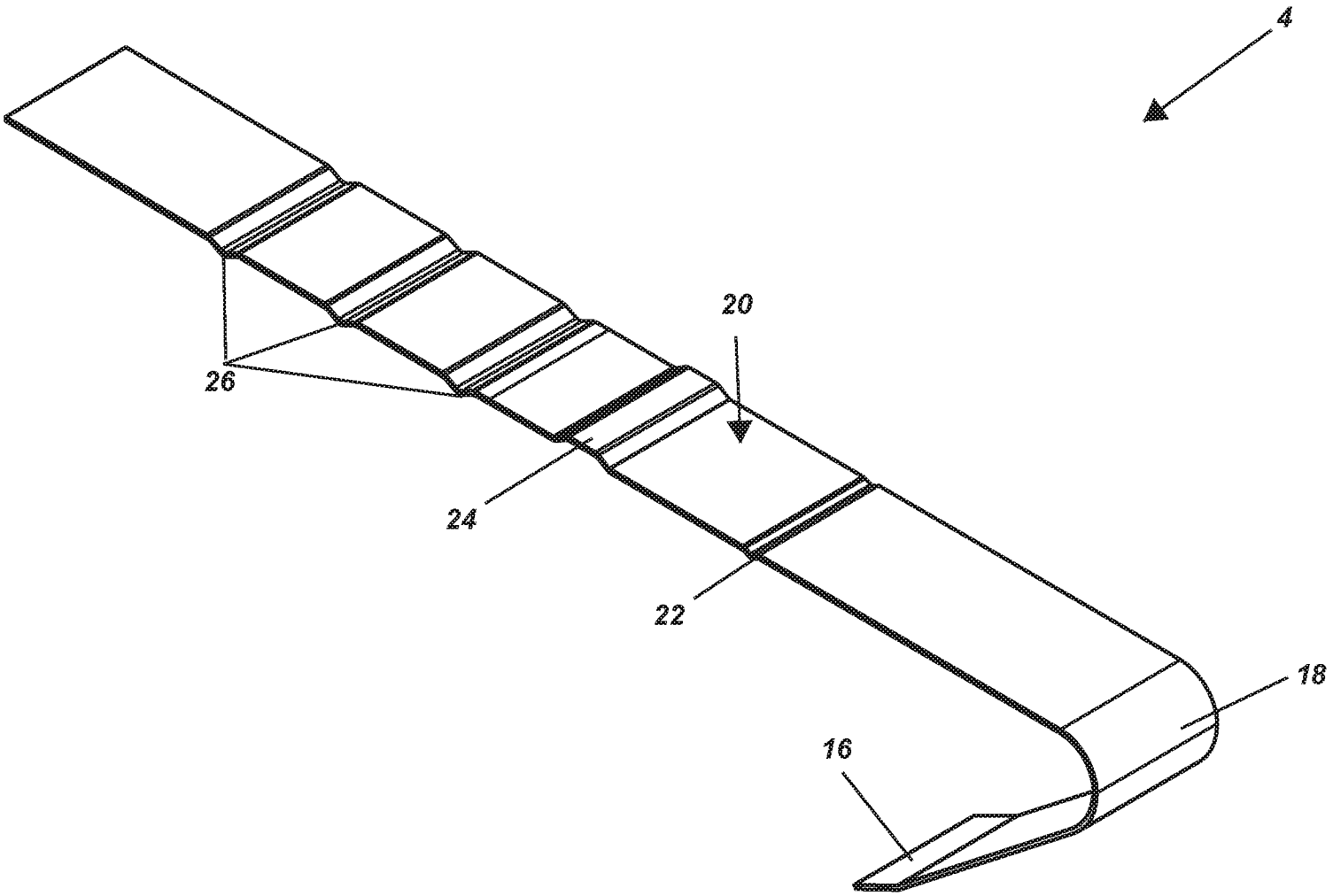
FIG. 2 is a three-dimensional isometric view of a top cover element thereof.
Figure 3:
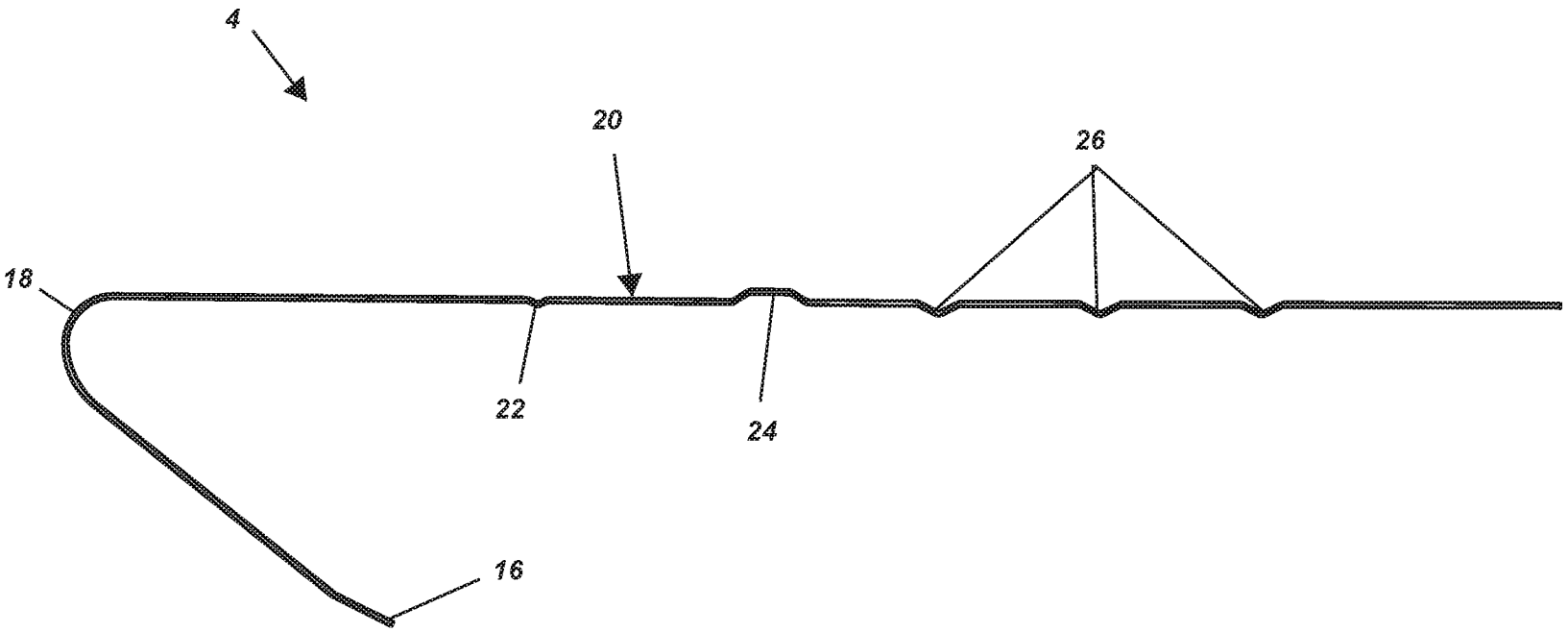
FIG. 3 is a side elevational view of the top cover element thereof.
Figure 4:
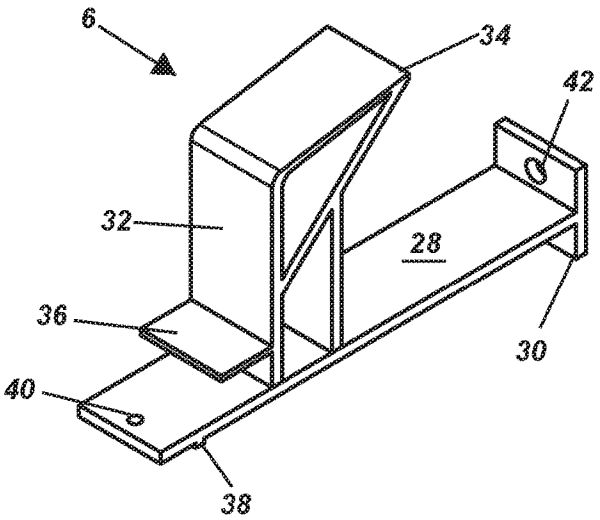
FIG. 4 is a three-dimensional isometric view of a bracket element thereof.
Figure 7:
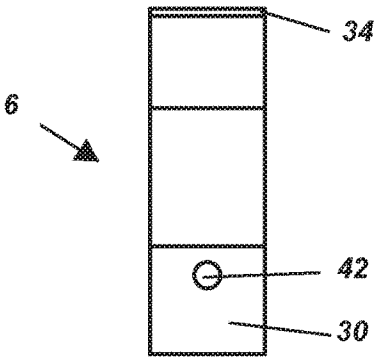
FIG. 7 is a rear elevational view of the bracket element thereof.
Figure 5:
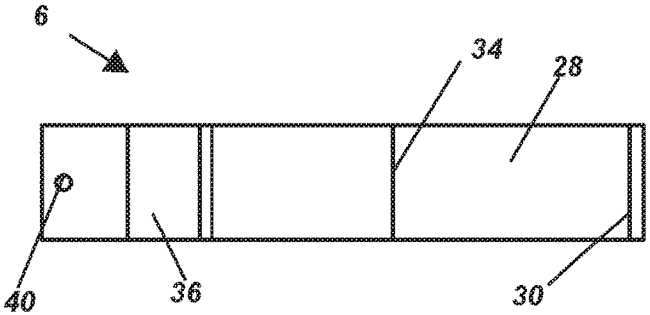
FIG. 5 is a top plan view of the bracket element thereof.
Figure 6:
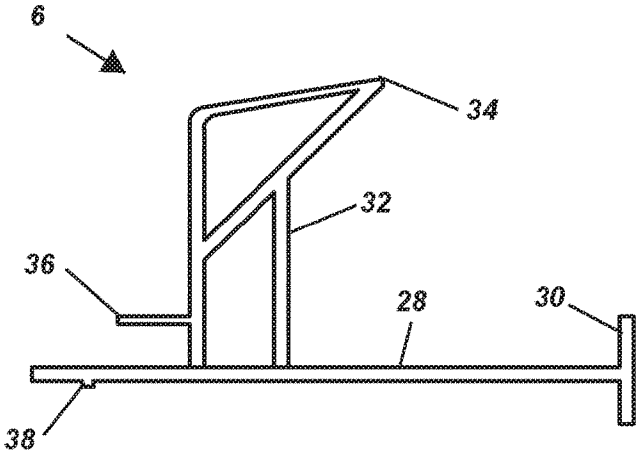
FIG. 6 is a side elevational view of the bracket element thereof.
Figure 8:
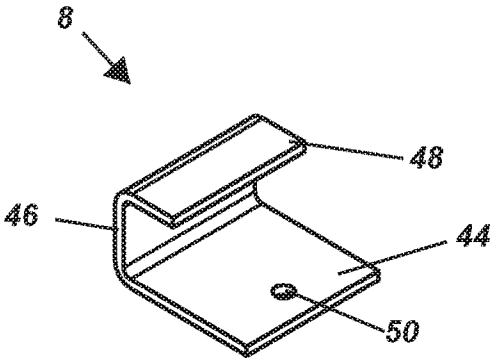
FIG. 8 is a three-dimensional isometric view of a clip element thereof.
Figure 9:
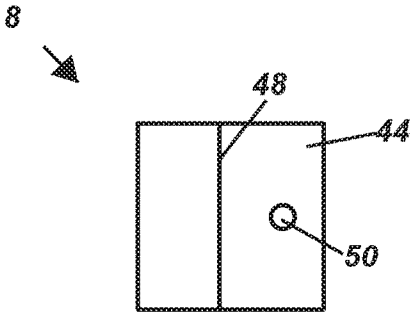
FIG. 9 is a top plan view of the clip element thereof.
Figure 11:
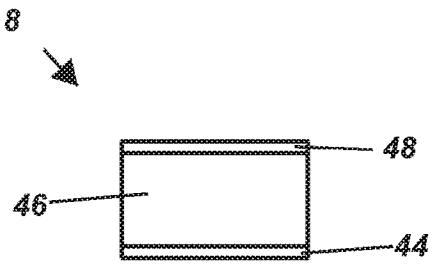
FIG. 11 is a rear elevational view of the clip element thereof.
Figure 10:
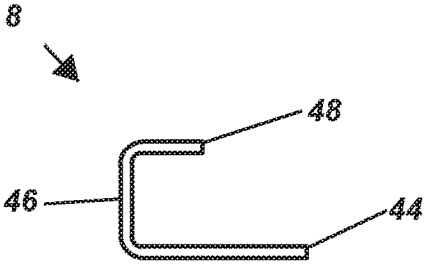
FIG. 10 is a side elevational view of the clip element thereof.

The cover 4, as shown in isolation in FIGS. 2 and 3, includes a front end 16 which angles into a gently curved nose 18 and back into a top surface 20 which is designed to protect the gutter 10 from being filled with leaves and other debris. Several structural indentions 22, 24, 26 break up the top surface and provide structural integrity which prevents the cover 4 from bending under debris or from bending and blowing in the wind. The cover is designed to not be physically affixed to the roof or gutter, but instead is designed to cover a portion of the roof, either over or underneath of the shingles. The terminal end 27 of the cover 4 can be slipped beneath roof shingles or otherwise secured to the top face of the shingles.

The mounting bracket 6, as shown in more detail in FIGS. 4-7, is placed between the rear wall 14 and front lip 12 of the gutter. The front end of the bracket 6 connects with a clip 8 which fits within the lip 12 of the gutter 10. A nodule 38 helps to lock the clip 8 to the bracket 6. The bracket 6 has a mounting hole 40 which corresponds with a mounting hole 50 of the clip 8 for securing the two elements together.

The mounting bracket 6 includes a foot 30 which is placed against the rear wall 14 of the gutter 10 and includes a mounting hole 42 for receiving a screw or nail or other anchoring device for securing the bracket 6 through the gutter 10 and into the structure of the building the gutter is attached to.

The mounting bracket 6 includes a structural tower 32 extending up from the base platform 28. The structural tower 32 includes a top end point 34 which supports the cover 4 and raises it above the gutter's interior. A front ledge 36 receives the front end 16 of the cover 4.

The clip element 8 merely includes a lower surface 44, and an upper surface 48 which are joined by a vertically-oriented rear wall 46. This clip interfaces with the front lip 12 of a typical gutter 10 and is secured to the bracket 6 using a screw or nut and bolt or some other standard anchoring device.

Figure 12:
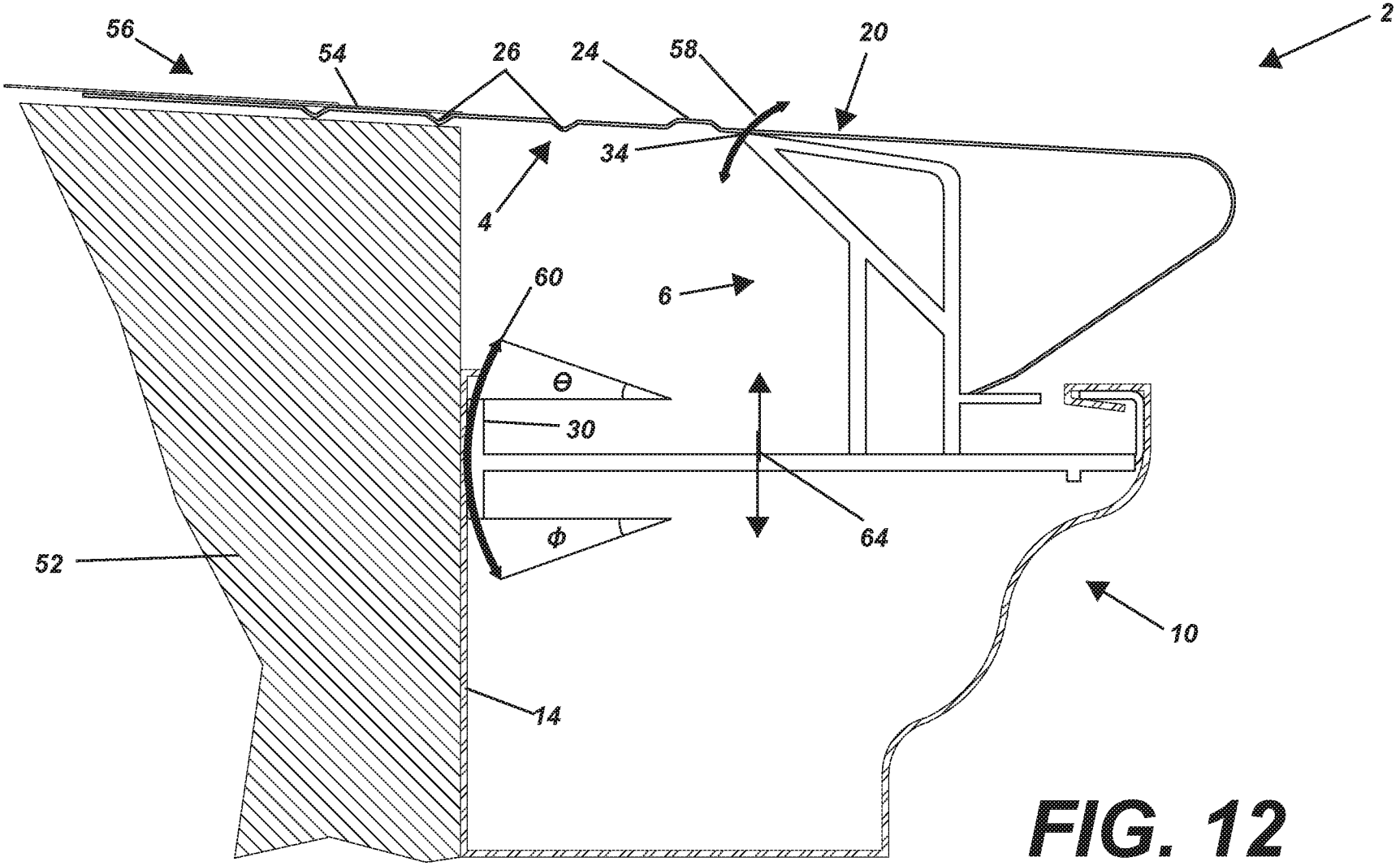
FIG. 12 is a side sectional view of the embodiment of FIG. 1 shown with a wall and roof structure.

FIG. 12 shows how the gutter cover system 2 is modifiable with the gutter 10. By adjusting the foot along the back wall 14 of the gutter 10 about the arc 60, the gutter cover system 2 can be installed on-site with different gutters and adjusted up by an angle θ or down by an angle ϕ. The angle θ could be as much as 13.5° and the angle ϕ could be as much as 17°. This would adjust the height of the top end point 34 of the bracket 6 to adjust based upon the pitch of the roof 56 along the arc 58. The cover 4 is inserted underneath the first run of shingles 54 above the building structure 52. A higher pitched roof may require that the cover 4 be angled upward, while a lower pitched roof may require the cover to be angled downward more than usual. Additionally, the bracket 6 can be adjusted vertically about the axis 64 to fit different gutter types as needed for instant on-site modification. The height would depend upon the location of the front lip of the gutter.

Figure 13:
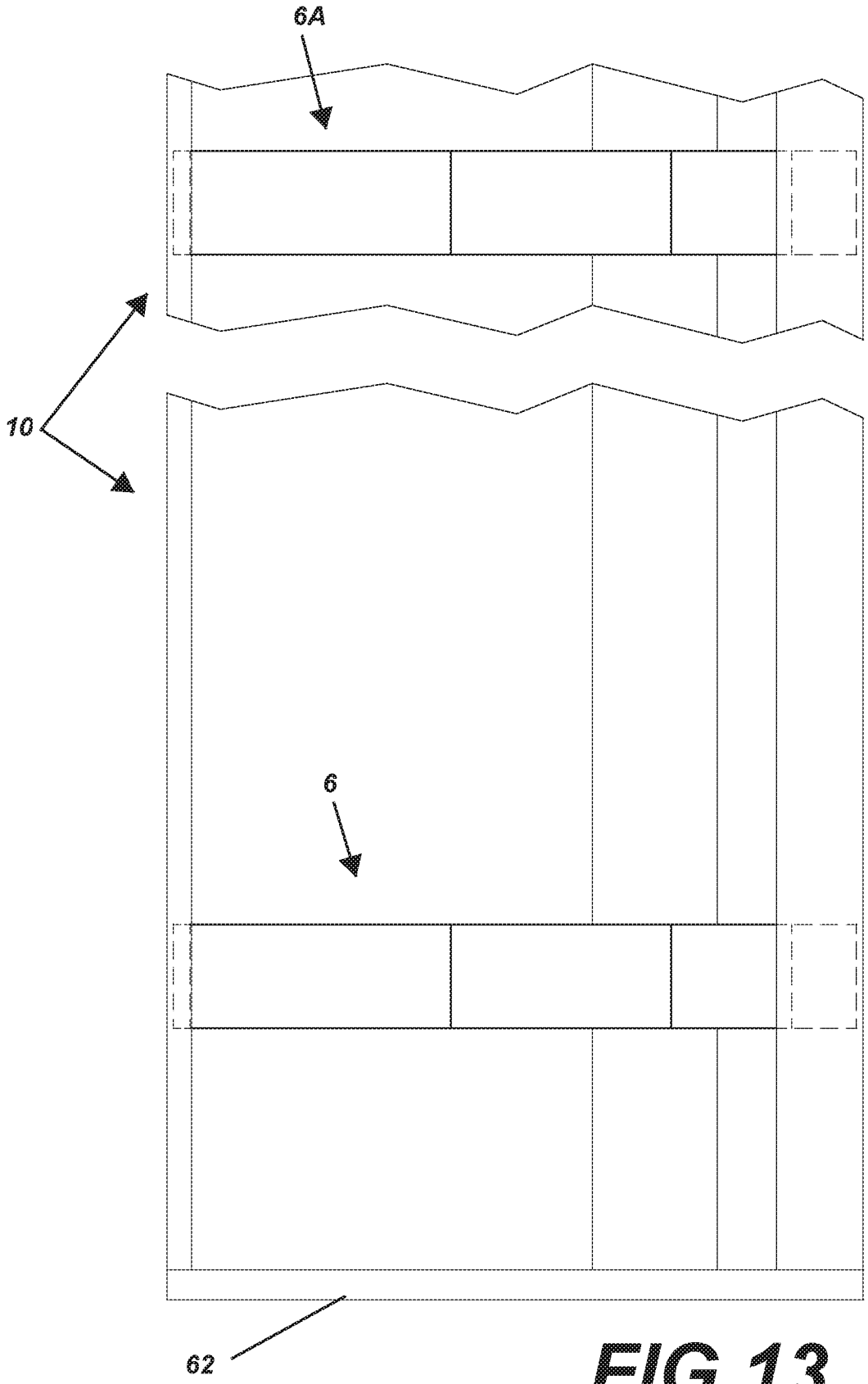
FIG. 13 is a top plan view of the embodiment of FIG. 4 shown in a gutter element.

FIG. 13 shows how the bracket 6 is installed within the gutter 10. The bracket 6 would be installed away from the edges 62 of the gutter, allowing for customization of placement as shown in FIG. 12 as the bracket 6 is not fixed into the gutter edge. Additional brackets, such as bracket 6A can be installed along the length of the gutter 10 as needed to support the cover 4.

III. Alternative Embodiment Gutter Cover System 102

Figure 14:
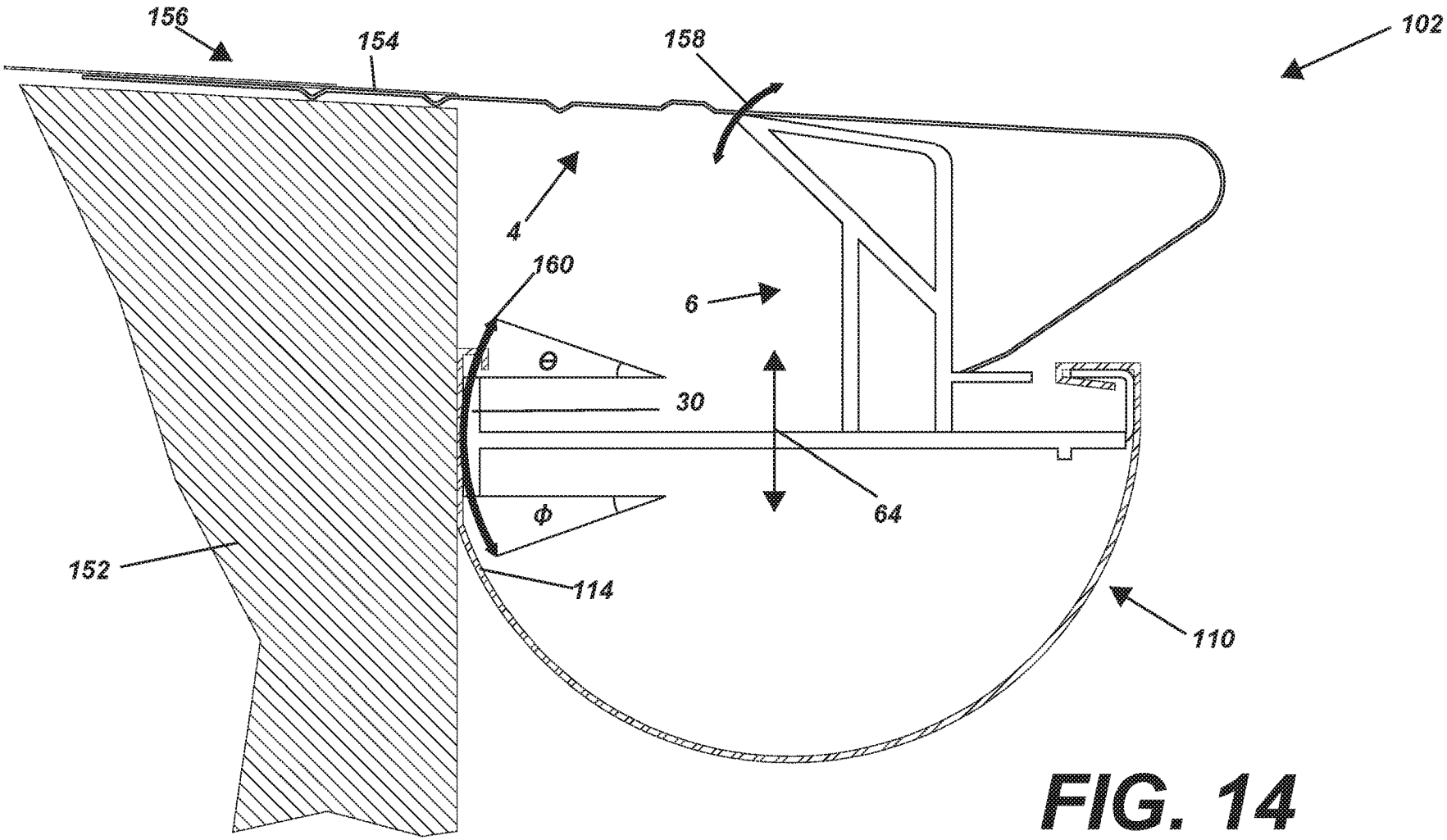
FIG. 14 is a side sectional view of the embodiment of FIG. 1 shown in an alternative embodiment gutter system.

FIG. 14 shows how the same gutter cover 4 and bracket 6 can be installed in a half-round gutter 110 for an alternative embodiment gutter cover system 102. The ability to adjust the angle and mounting height of the bracket as shown in FIG. 12 and FIG. 14 allows for use of the present invention in different gutters. Again, the cover 4 is inserted under the first run of shingles 154 of the roof 156 above the building structure 152. The angle of the foot 30 is adjusted as shown at 160, which adjusts the top end point 34 by the angle 158 to fit different roof pitches. The foot 30 can be placed as needed along the rounded back wall 114 of the half-round gutter 110. These types of gutters are found in older homes, allowing the present invention to be used for on-site modification and broad use among gutter types.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A gutter cover system comprising:

an adjustable cover element comprising a top surface, a curved front nose, and a front end, said adjustable cover element configured to engage with any roof pitch;

an adjustable mounting bracket configured for installation within a gutter, said mounting bracket comprising a rear T-shaped foot, a free-standing structural tower, and a front end;

said free-standing structural tower comprising a first wall and a second wall, wherein said first wall and second wall define a space between said first wall and said second wall, and an upper portion having an upper structure, a lower structure, and a vertical structure connecting said upper structure and said lower structure such that said upper structure, lower structure, and vertical structure define a space having a triangular cross section, wherein said lower structure connects to said first wall and said second wall;

a clip configured for placement within a front lip of said gutter, said clip further configured to be connected to said front end of said mounting bracket;

said adjustable mounting bracket being vertically adjustable within said gutter such that said mounting bracket rear T-shaped foot comprising a mounting hole for receiving an anchor configured to secure said mounting bracket to a structural element behind a rear wall of said gutter, wherein placement of said rear T-shaped foot in relation to said structural element is adjustable based upon a depth of said gutter;

said cover element configure to be placed atop said mounting bracket such that a bottom face of said top surface contacts a top end point of a sloped top face of said free-standing structural tower, and said front end of said cover element contacts a ledge on said free-standing structural tower; and said cover element further comprising a plurality of structural indentions on a portion of said cover element located behind said free-standing structural tower, said plurality of structural indentions configured to prevent said cover from sagging and for adjusting said cover element to fit said roof pitch.

2. The gutter system of claim 1, further comprising:

wherein said gutter comprises a half-round gutter having a rounded back face; and wherein said adjustable mounting bracket is configured for placement within said half-round gutter.

3. The gutter cover system of claim 1, further comprising: said plurality of structural indentions comprising at least one downward-oriented indention and one upward-oriented indention.

4. The gutter cover system of claim 1, further comprising:

said mounting bracket front end comprising a first mounting hole;

said clip comprising a second mounting hole; and an anchor configured to be placed within said first mounting hole and second mounting hole to secure said clip to said mounting bracket.

5. The gutter cover system of claim 1, wherein a terminal end of said cover element is configured to be affixed beneath a first course of roof shingles located in proximity with said gutter.

6. The gutter cover system of claim 1, further comprising:

said foot adjustable about an arc such that said top end point adjusts said cover based upon a pitch of said roof.

7. The gutter system of claim 6, wherein said foot is adjustable to an angle of 13.5° upward and 17° downward.

8. The gutter system of claim 1, further comprising:

said foot and bracket configured to be adjusted vertically along an axis parallel with a back face of said gutter to a mounting point; and said mounting point dependent upon a vertical location of said front lip of said gutter.

* * * * *